US008007345B2

(12) United States Patent
Onose et al.

(10) Patent No.: US 8,007,345 B2
(45) Date of Patent: Aug. 30, 2011

(54) PORTABLE BELT SANDER

(75) Inventors: Akira Onose, Hitachinaka (JP); Toshiaki Takagi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/959,930

(22) Filed: Dec. 19, 2007

(65) Prior Publication Data

US 2008/0171497 A1 Jul. 17, 2008

(30) Foreign Application Priority Data

Dec. 19, 2006 (JP) ..... P2006-340647

(51) Int. Cl.
*B24B 23/00* (2006.01)

(52) U.S. Cl. ..... 451/297; 451/350; 451/355

(58) Field of Classification Search ..... 451/297, 451/344, 350, 355
See application file for complete search history.

(56) References Cited

U.S. PATENT DOCUMENTS 5,223,599 A * 6/1993 Gajewski ..... 528/59
5,233,725 A * 8/1993 Lautenschlager ..... 16/107
7,011,084 B2 * 3/2006 Richard ..... 124/78
7,846,011 B2 * 12/2010 Wall et al. ..... 451/296
2002/0009962 A1 * 1/2002 Swaddle et al. ..... 451/355
2008/0095626 A1 * 4/2008 Krogmeier et al. ..... 416/146 R
2010/0284642 A1 * 11/2010 Mineno et al. ..... 384/569

FOREIGN PATENT DOCUMENTS

CN 1147603 4/1997
JP 2000-280157 10/2000

OTHER PUBLICATIONS

Chinese Office Action issued Mar. 13, 2009 in Chinese Application No. 200710300194.7, and English translation of Chinese Office Action.

* cited by examiner

*Primary Examiner* — Eileen P. Morgan
(74) *Attorney, Agent, or Firm* — Antonelli, Terry, Stout & Kraus, LLP.

(57) ABSTRACT

A portable belt sander having a drive pulley capable of being produced at a limited period. The sander includes a main body accommodating therein a motor, a drive shaft rotationally driven by the motor, a drive pulley coupled to the drive shaft, a driven shaft, and an endless polishing belt mounted between the drive pulley and the driven pulley. The drive pulley includes a base section coupling the drive shaft and made from a rigid material, and an outer low hardness section made from an elastomer material and disposed over an outer peripheral surface of the base section and integrally therewith by injection molding. Mating surfaces between the base section and the outer section are irregularly formed.

9 Claims, 7 Drawing Sheets

PRIOR ART

PRIOR ART

PORTABLE BELT SANDER

TECHNICAL FIELD

The present invention relates to a portable belt sander for polishing a workpiece.

BACKGROUND ART

A portable belt sander includes a drive pulley, a driven pulley and an endless polishing belt mounted over the drive and driven pulleys. Rotation of the drive pulley provides a circulating movement of the belt so as to polish a surface of the workpiece.

A conventional drive pulley 102 is shown in FIGS. 12 and 13. The drive pulley 102 includes a drive shaft 107 drivingly connected to a motor (not shown), a base section 108, and an outer section 109. The base section 108 is coupled to the drive shaft 107 and is made from rigid or high hardness material such as aluminum and a resin. The outer section 109 is covered or crowned over the base section 108 and is made from a soft or low hardness material such as a rubber having high frictional resistance so as to avoid slippage of the polishing belt with respect to the outer section 109 to ensure circulating movement of the endless belt. Such conventional structure is shown in laid open Japanese patent application publication No. 2000-280157.

The outer section 109 made from the rubber is fixed to the outer peripheral surface of the base section 108 by baking (forming) with employing expensive two-part adhesive. Prior to baking, various processes must be required such as degreasing an adhesion surface of the base section 108, drying the surface, coating a first adhesive, drying the first adhesive, coating a second adhesive and drying the second adhesive. Such preliminary processes require almost one day, and rubber forming requires about 10 to 20 minutes. Accordingly, a resultant drive pulley 102 becomes expensive.

SUMMARY

It is therefore an object of the present invention to provide a low cost portable belt sander having a drive pulley that can be manufactured within a short period.

This and other objects of the present invention will be attained by a portable belt sander including a main body, a drive shaft, a drive pulley, a driven pulley, and an endless polishing belt. The main body accommodates therein a motor. The drive shaft is rotationally driven by the motor. The drive pulley is coupled to the drive shaft, and includes a base section and an outer low hardness section. The base section is coupled to the drive shaft and is made from a rigid material. The outer low hardness section is made from an elastomer material and is disposed over an outer peripheral surface of the base section and integrally therewith by injection molding. The driven pulley is rotatable upon rotation of the drive pulley. The endless polishing belt is mounted between the drive pulley and the driven pulley.

EMBODIMENTS

Figure 1:
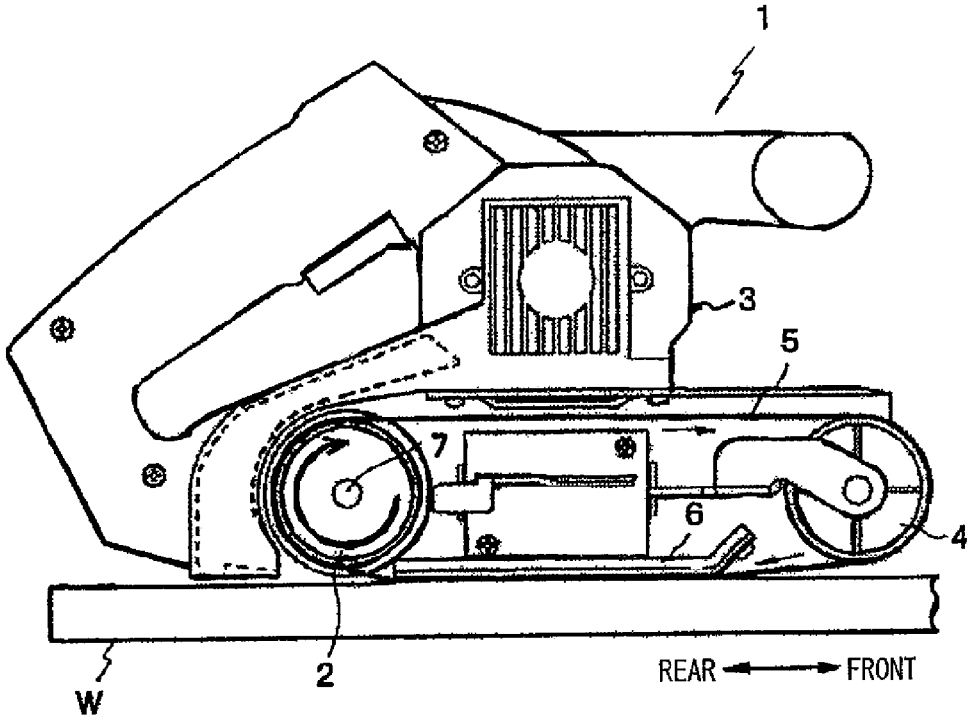
FIG. 1 is a right side view of a portable belt sander according to a first embodiment of the present invention.
Figure 2:
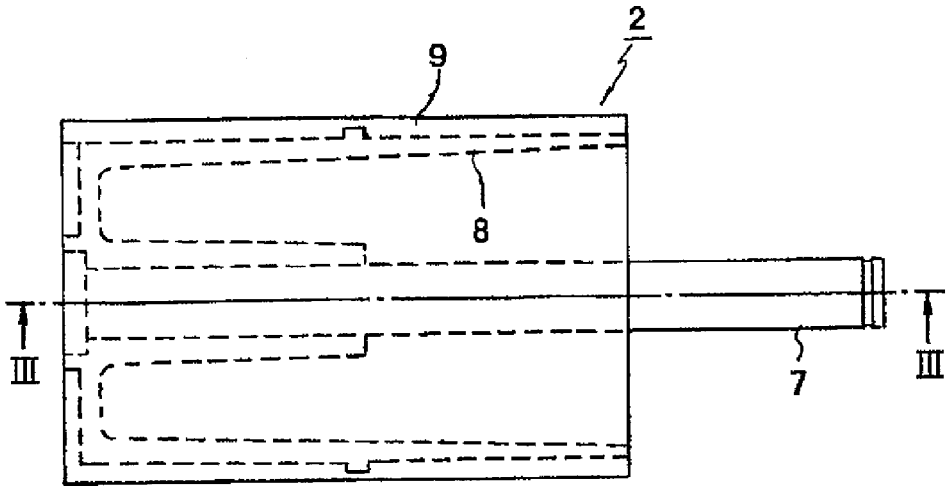
FIG. 2 is a front view of a drive pulley in the portable belt sander according to the first embodiment.

A portable belt sander according to a first embodiment of the present invention will be described with reference to FIGS. 1 through 8. A portable belt sander 1 is shown in FIG. 1 where right side and left side correspond to front and rear side, respectively. The sander 1 includes a main body 3, a drive pulley 2, a driven pulley 4 and an endless polishing belt 5. The main body 3 accommodates therein a motor (not shown). The drive pulley 2 is disposed at a lower rear portion of the main body 3, and is rotatable in a direction indicated by an arrow by the motor. The driven pulley 4 is rotatably disposed at a lower front portion of the main body 3. The endless polishing belt 5 is mounted between the drive pulley 2 and the driven pulley 4. A guide plate 5 extends between the drive pulley 2 and the driven pulley 4, so that the endless polishing belt 5 runs immediately below the guide plate 5 and above a workpiece W during polishing a surface of the workpiece W.

Figure 3:
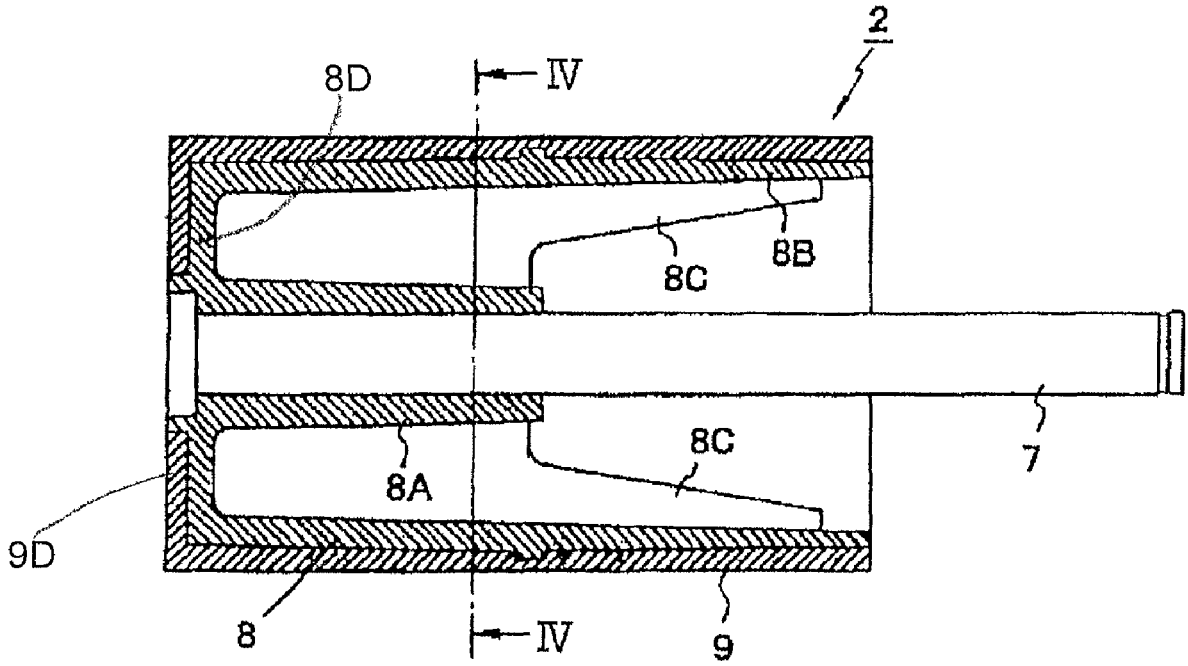
FIG. 3 is a cross-sectional view taken along the line III-III in FIG. 2.
Figure 4:
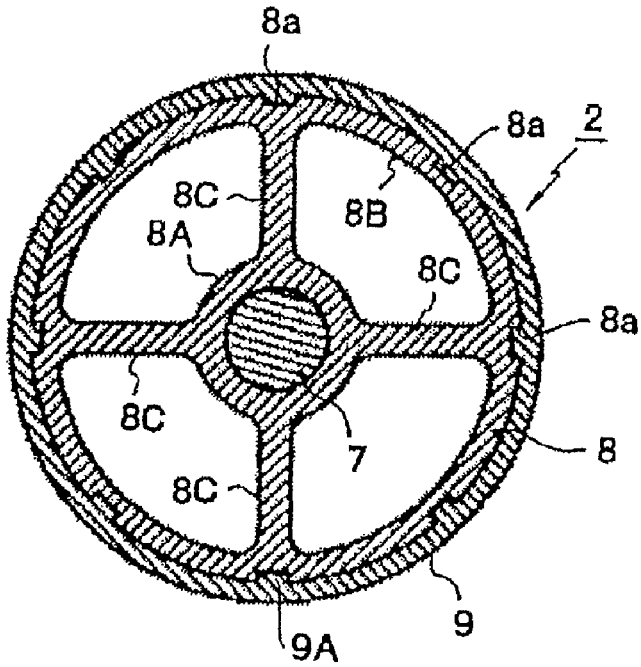
FIG. 4 is a cross-sectional view taken along the line IV-IV in FIG. 3.

The drive pulley 2 includes a base section 8 and an outer section 9. The base section 8 includes a central boss part 8A and an outer drum part 8B integral therewith, e.g. connected to the central boss part 8A by way of an end section 8D and four ribs 8C extending radially inwardly from the outer drum part 8B to the central boss part 8A as shown in FIGS. 3 and 4. The base section 8 is made from a rigid or high hardness material such as aluminum and a resin. A separate drive shaft 7 is force-fitted with the boss part 8A. The drive shaft 7 has one end coupled with a gear (not shown) that transmits rotation of the motor (not shown) to the drive shaft 7 to thus rotate the drive pulley 2.

Figure 5:
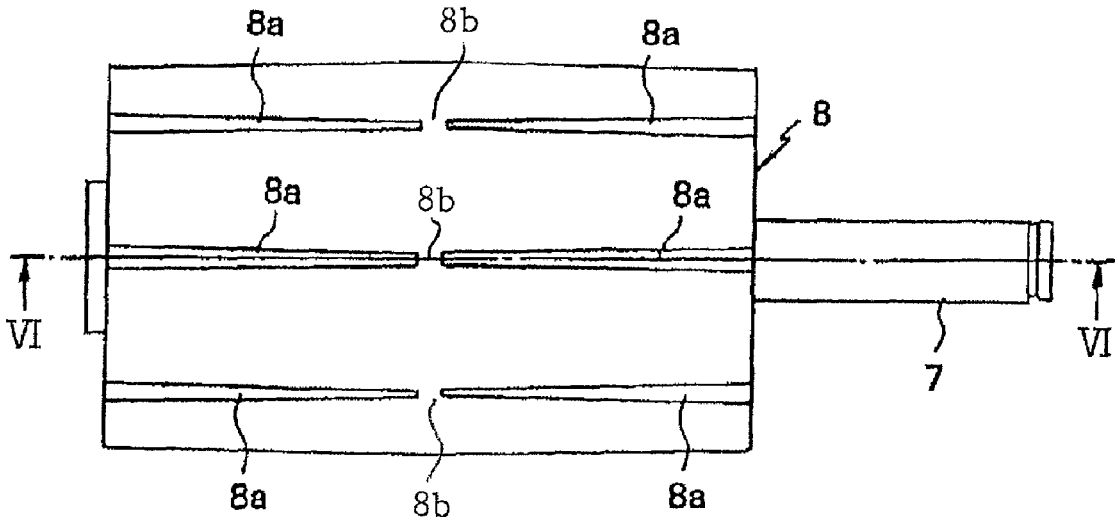
FIG. 5 is a front view of a base section of the drive pulley in the portable belt sander according to the first embodiment.
Figure 6:
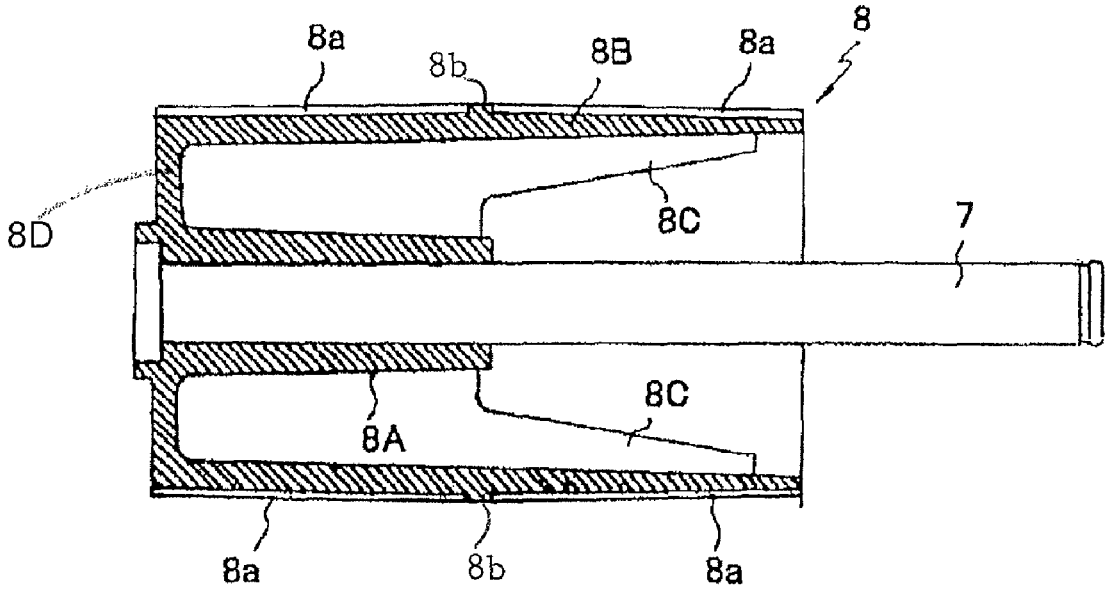
FIG. 6 is a cross-sectional view taken along the line VI-VI in FIG. 5.

As shown in FIG. 3, the outer drum part 8B is provided concentrically with the boss part 8A. The drum part 8B is integrally connected to the boss part 8A through the end section 8D and the four ribs 8C extending in a radial direction between the boss part 8A and the drum part 8B. As shown in FIGS. 4 through 6, a plurality of elongated grooves 8*a* are formed on an outer peripheral surface of the drum part 8B. Each groove 8*a* extends in parallel with an axial direction of the drum part 8B, and spaced away from each other in a circumferential direction by every 45 degrees. Each groove does not extend to an axially center portion 8*b* of the drum part 8B as seen in FIGS. 5 and 6. Therefore, totally eight grooves 8*a* are formed at a left part of the drum part 8B, and totally eight grooves 8*a* are formed at a right part of the drum part 8B, and left part grooves and right part grooves are aligned with each other in the axial direction and separated from one another at 8*b* along the outer peripheral surface as shown in FIG. 6. Further, a width of each groove is gradually increased toward each end of the drum part 8B as best shown in FIG. 5.

The outer section 9 is fitted over the outer peripheral surface of the drum part 8B and an end section 9D of the outer section is fitted over the outer end face of end section 8D of the base section 8 as shown in FIG. 3. The outer section 9 is made from a soft or low hardness material such as an elastomer that becomes integral with the base section 8 by injection molding. The outer section 9 has a plurality of elongated protruding parts 9A extending in the axial direction and protruding radially inwardly from its inner peripheral surface so as to engage with corresponding grooves 8*a*. Since the protruding parts 9A are engaged with the grooves 8*a*, peeling of the outer section 9 from the base section 8 can be avoided. Moreover, since the protruding parts 9A are engaged with the grooves 8*a* over a length of the drum part 8B except the central part thereof, displacement of the outer section 9 relative to the base section 9 in a circumferential direction thereof can be prevented even if a large load is applied to the polishing belt 5. Further, since this engagement is not made at the central part of the drum part 8B, and since each groove width is gradually increased toward each axial end of the drum part 8B, displacement of the outer section 9 relative to the base section 8 in the axial direction can also be prevented.

Figure 7:
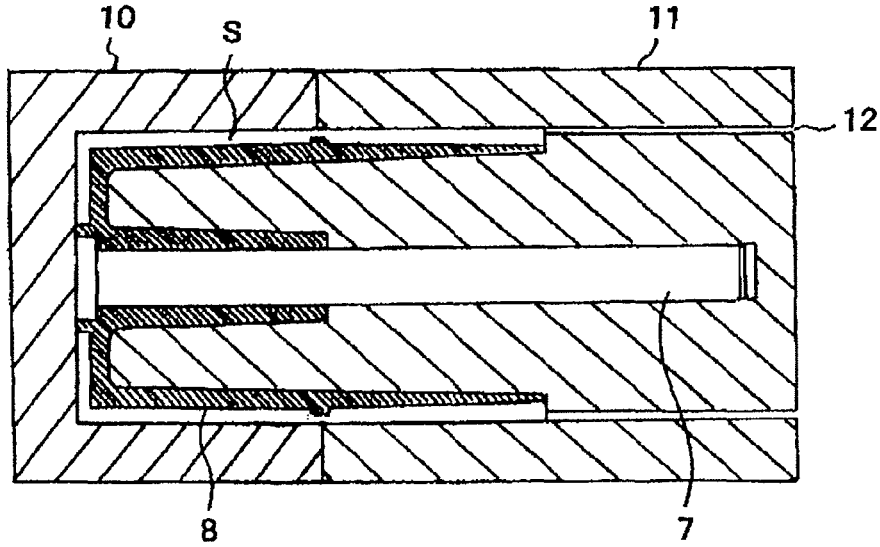
FIG. 7 is a cross-sectional view of a metal mold for injection molding the drive pulley prior to molding an outer section.
Figure 8:
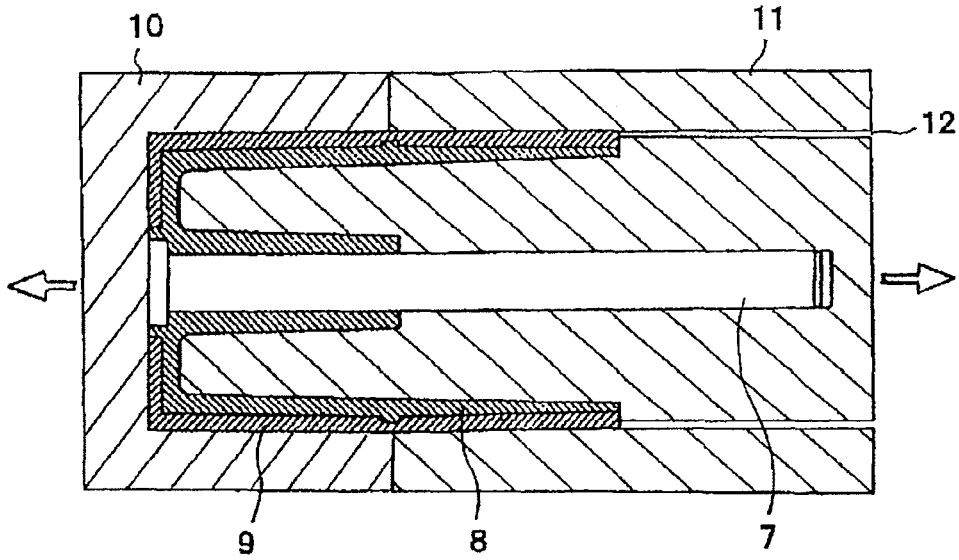
FIG. 8 is a cross-sectional view of the metal mold for injection molding the drive pulley after molding the outer section.

FIG. 7 shows a metal mold for injection-molding the outer section 9 over the base section 8. Left and right halves of metal molds 10 and 11 whose parting face extends perpendicular to the axial direction of the drive shaft 7 are used. The metal mold is so designed that a cylindrical space S corresponding to the outer section 9 is provided when the base section 8 together with the drive shaft 7 fitted therewith are set in the metal mold. The right metal mold half 11 is formed with a molten material supply port 12 in communication with the space S.

Upon solidifying the elastomer material in the space S after injection of the molten elastomer material into the space S through the port 12, the outer section 9 can be provided over the base section 8, while the protrusions 9A of the elastomer are embedded into the grooves 8*a*. Thereafter, the left and right mold halves 10 and 11 are relatively moved away from each other to take out the drive pulley 2.

As described above, expensive adhesive can be dispensed with for molding the outer section, since the outer section 9 can be molded integrally with the base section 8 by injection molding with elastomer material. In other words, preliminary processes such as degreasing, drying, and coating adhesive etc., can be eliminated. Consequently, the drive pulley 2 can be produced within a limited period to lower its production cost.

Figure 9:
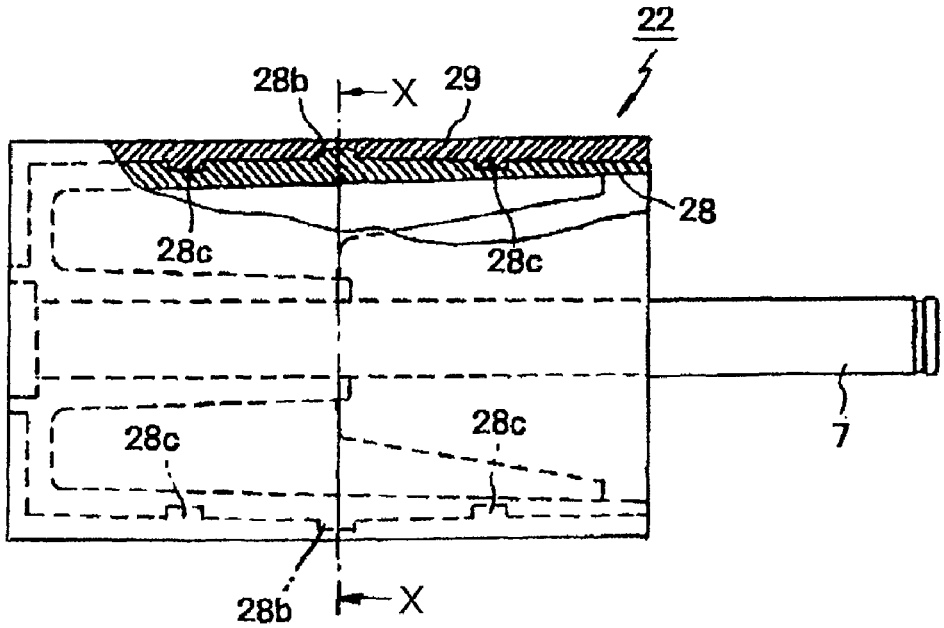
FIG. 9 is a partially cross-sectional front view of a drive pulley in a portable belt sander according to a second embodiment of the present invention.
Figure 10:
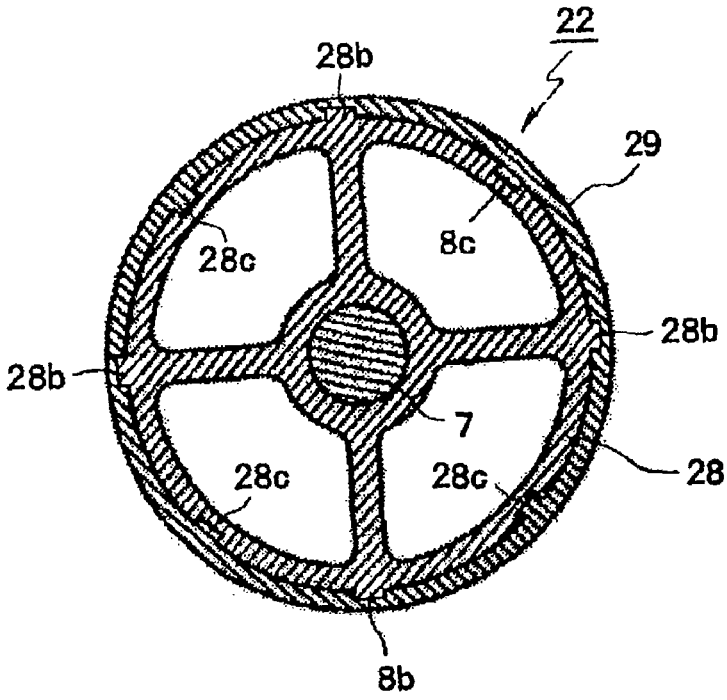
FIG. 10 is a cross-sectional view taken along the line X-X in FIG. 9.
Figure 11:
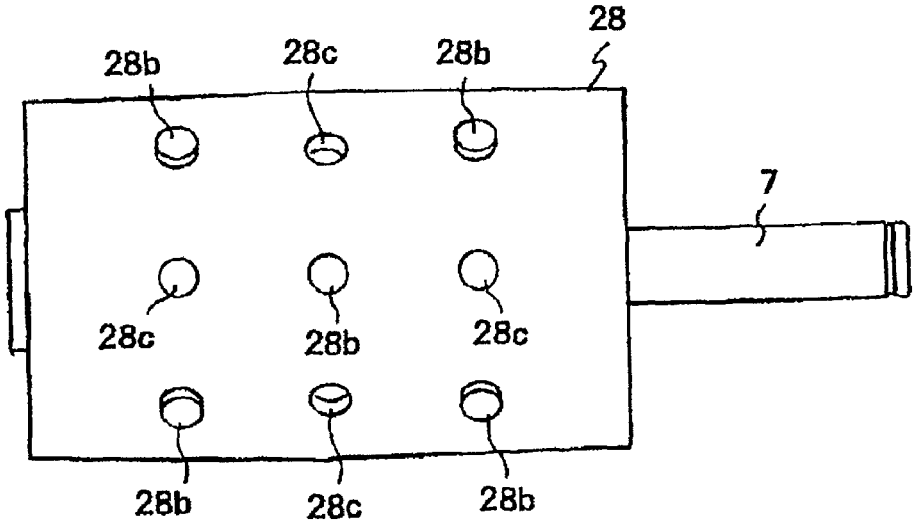
FIG. 11 is a front view of a base section in the drive pulley in the portable belt sander according to the second embodiment.
Figure 12:
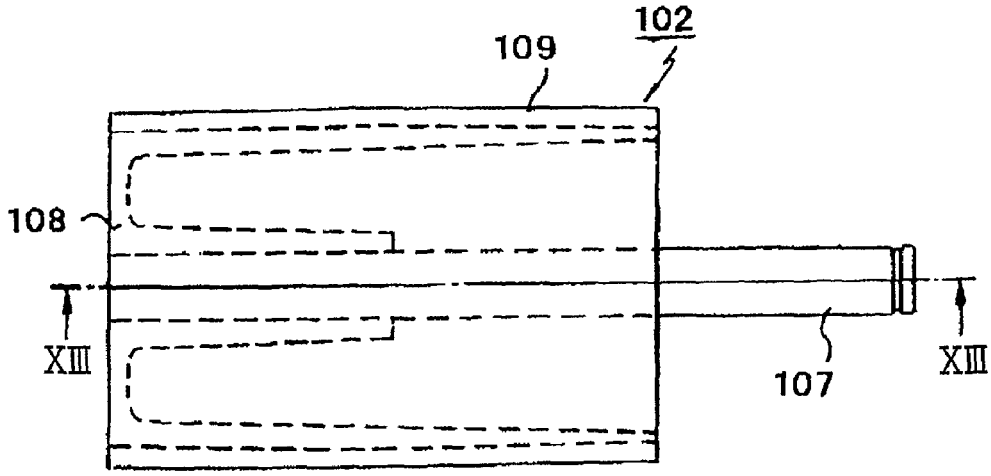
FIG. 12 is a front view of a conventional drive pulley.
Figure 13:
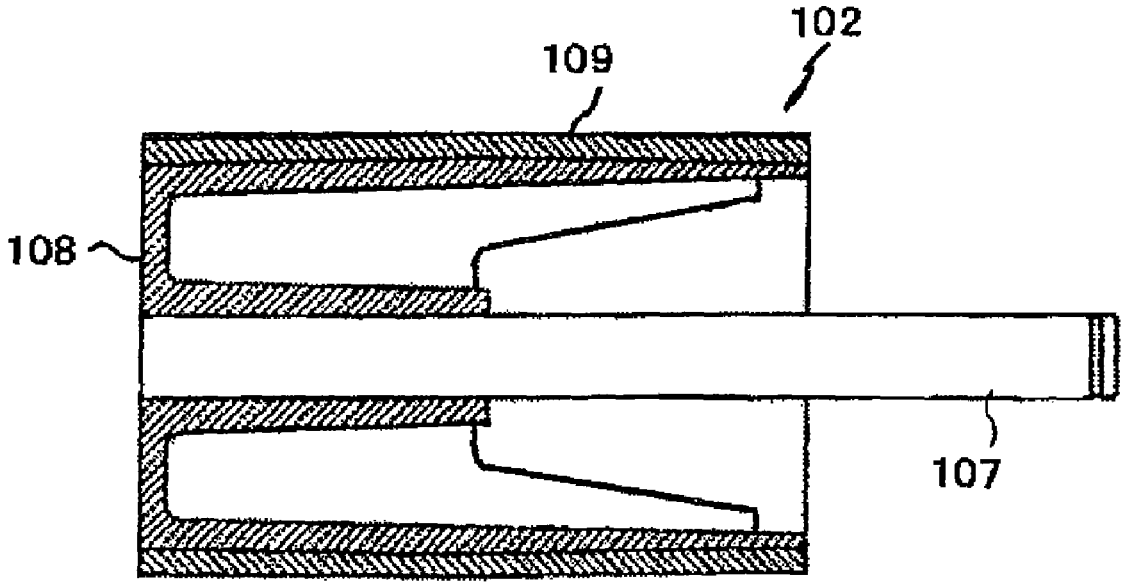
FIG. 13 is a cross-sectional view taken along the line XIII-XIII in FIG. 12.

A portable belt sander according to a second embodiment of the present invention is shown in FIGS. 9 through 11. The second embodiment is the same as the first embodiment in injection molding the elastomer material over the base section. However, configurations of the base section and outer section are different from those of the first embodiment.

The base section 28 has an outer surface formed with cylindrical protrusions 28*b* and circular recesses 28*c*. More specifically, four cylindrical protrusions 28*b* are arrayed in a circumferential direction of the base section 28 at every 90 degrees, and four circular recesses 28*c* are arrayed in the circumferential direction at every 90 degrees, and cylindrical protrusions 28*b* and circular recesses are alternately arrayed in the circumferential direction at every 45 degrees. Further, the cylindrical protrusions 28*b* and circular recesses are alternately arrayed in an axial direction of the base section 28.

The outer section 29 has corresponding circular recesses fitted with the circular protrusions 28*b* and cylindrical protrusions fitted with the circular recesses 28*c*. The outer section 29 can be integrally crowned over the base section 28 by injection molding the elastomer material similar to the first embodiment. Peeling of the outer section 29 from the base section 28 can be prevented by the fitting engagement between the circular recesses of the outer section 29 with the circular protrusions 28*b* and cylindrical protrusions of the outer section 29 with the circular recesses 28*c*. Moreover, displacement of the outer section 29 with respect to the base section in the circumferential direction as well as in the axial direction can be prevented even if large load is imparted to the polishing belt 5. Furthermore, because of the employment of injection molding, the drive pulley 2 can be produced within a limited period to lower its production cost.

Various modifications are conceivable with respect to the configuration of the base section and outer section. For example, the outer surface of the base section only has a plurality of protrusions whereas the inner surface of the outer section only has complementary recesses, or vice versa.

While the invention has been described in detail and with reference to specific embodiments thereof, it would be apparent to those skilled in the art that various changes and modifications may be made therein without departing from the spirit and scope of the invention.

The invention claimed is:

1. A portable belt sander comprising:

a main body accommodating therein a motor;

a drive shaft rotationally driven by the motor;

a drive pulley coupled to the drive shaft to rotate therewith;

a driven pulley rotatably disposed at a lower portion of the main body; and a polishing belt mounted between the drive pulley and the driven pulley;

wherein the drive pulley comprises:

a cylindrical base section coupled to the drive shaft and made from a rigid material, the base section having an outer end face and an outer peripheral surface extending in an axial direction of the base section;

a plurality of protrusions formed on the outer peripheral surface and spaced away from each other in the circumferential direction of the outer peripheral surface, the plurality of protrusions extending in the axial direction; and an outer low hardness section made from an elastomer material by injection molding and formed over the outer end face and the outer peripheral surface of the cylindrical base section, the outer low hardness section having an inner peripheral surface formed with a plurality of complementary recesses fittingly engaged with the protrusions on the outer peripheral surface of the base section.

2. The portable belt sander as claimed in claim 1, wherein the low hardness section is formed by injection molding of the elastomer, using metal mold halves whose parting face extends in a direction perpendicular to an axial direction of the drive shaft when the drive shaft assembling with the base section are set to the mold halves.

3. The portable belt sander as claimed in claim 1, wherein the plurality of complementary recesses formed on the inner peripheral surface of the low hardness section are elongated grooves each extending in the axial direction of the base section, and wherein the plurality of protrusions formed on the outer peripheral surface of the base section are fittingly engaged with the elongated grooves.

4. A portable belt sander comprising:

a main body accommodating therein a motor;

a drive shaft rotationally driven by the motor;

a drive pulley coupled to the drive shaft to rotate therewith;

a driven pulley rotatably disposed at a lower portion of the main body; and a polishing belt mounted between the drive pulley and the driven pulley;

wherein the drive pulley comprises:

a cylindrical base section coupled to the drive shaft and made from a rigid material, the base section having an outer end face and an outer peripheral surface extending in an axial direction of the base section and having a plurality of recesses on the outer peripheral surface, the recesses being spaced away from each other in the circumferential direction of the outer peripheral surface of the base section;

a low hardness section made from an elastomer material by injection molding and formed over the outer end face and the outer peripheral surface of the cylindrical base section; and a plurality of complementary protrusions formed on an inner surface of the low hardness section and fittingly engaged with the recesses formed on the outer peripheral surface of the base section, the plurality of protrusions extending in the axial direction.

5. The portable belt sander as claimed in claim 4, wherein the plurality of recesses formed on the outer peripheral surface of the base section are elongated grooves each extending in the axial direction of the base section and arrayed in a circumferential direction of the base section, and wherein the plurality of complementary protrusions formed on the inner surface of the low hardness section are fittingly engaged with the elongated grooves.

6. The portable belt sander as claimed in claim 5, wherein each elongated groove has a width gradually increasing toward an axial end of the base section.

7. A portable belt sander comprising:

a main body;

a motor disposed in the main body and having a drive shaft rotationally driven by the motor;

a drive pulley coupled to the drive shaft and disposed at a rear portion of the main body;

a driven pulley rotatably disposed at a front portion of the main body; and a polishing belt mounted between the drive pulley and the driven pulley;

wherein the drive pulley comprises:

a base section including a central boss part mounted on the drive shaft, an outer end face, and an outer drum part integrally connected outer end face and the to the boss part and extending in an axial direction of the base section, the base section being made from a rigid material;

a plurality of protrusions or recesses formed on an outer peripheral surface of the drum part, the plurality of protrusions or recesses extending in the axial direction;

a low hardness section made from an elastomer material by injection molding and disposed over the outer peripheral surface of the drum part and the outer end face of the base section; and a plurality of complementary recesses or protrusions formed on an inner surface of the low hardness section and fittingly engaged with the protrusions or recesses formed on the outer peripheral surface of the drum part.

8. The portable belt sander as claimed in claim 7, wherein the protrusions and recesses are elongated in the axial direction .

9. The portable belt sander as claimed in claim 8, wherein each of the elongated recesses has a width gradually increasing toward an axial end of the drum part.

* * * * *